US005435768A

United States Patent [19]

Dunleavy

[11] Patent Number: 5,435,768

[45] Date of Patent: Jul. 25, 1995

[54] REMOTE CONTROLLED MODEL TRASH TRUCK

[75] Inventor: Daniel W. Dunleavy, Montgomeryville, Pa.

[73] Assignee: Daniel J. O'Neill, Souderton, Pa.

[21] Appl. No.: 237,667

[22] Filed: May 4, 1994

[51] Int. Cl.[6] ..... A63H 17/05; A63H 17/39

[52] U.S. Cl. ..... 446/427; 446/456

[58] Field of Search ..... 446/427, 425, 424, 456

[56] References Cited

U.S. PATENT DOCUMENTS 3,757,464 9/1973 Gagnon ..... 446/427
4,617,002 10/1986 Ishimoto et al. ..... 446/427
4,917,648 4/1990 Hartje ..... 446/427 X

*Primary Examiner*—Mickey Yu
*Attorney, Agent, or Firm*—John W. Logan, Jr. & Associates

[57] ABSTRACT

Described is a remotely controlled miniature model trash truck with operating features that simulate those of a full size trash truck. The truck features moveable and controllable forks, fork frames, top access door, rear door, and an ejector blade. The mechanisms are remotely controllable by a direct current electric motor. The preferred motors are electric servo motors. The doors are actuable by the motors rotating eccentrics which are linked by rigid rods to the operating doors. An ejector blade is longitudinally moveable within the truck body by threadable engagement with a electric motor driven lead screw longitudinally mounted between the front end and rear opening of the truck box. The front fork frame is pivotally attached to the truck chassis and swingable between a loading position and dumping position by controllable excitation of a remotely controlled motor. Front forks are pivotally attached to the fork frame and positionable by actuation of a remotely controlled motor. The linkage from the front fork motor to the forks is via a series of control rods and rotary motion discs that transform the rotational motion of the motor to a reciprocating motion for transmission around the frame and thence back to a rotational motion.

8 Claims, 5 Drawing Sheets

REMOTE CONTROLLED MODEL TRASH TRUCK

BACKGROUND OF THE INVENTION

1. Field of the Invention

The present invention relates to remote controlled miniature trash trucks. Full size trash trucks of this type pick up a trash dumpster, swing the trash dumpster over the truck cab while a top access panel on the truck body opens, and then dump the trash through the access panel into the main truck body. In the full size truck, a trash pushing mechanism within the truck body compacts the trash toward the rear of the truck, and a rear door swings up to permit the trash pusher to force the trash out the rear door into a bin, hopper, or other collection point.

The remote controlled miniature model trash truck of the present invention simulates the operation of the conventional full size trash truck with novel radio controlled mechanisms.

2. Description of the Relevant Art

Conventional full size trash trucks of this type embody a fork frame pivotally attached to truck chassis at some point rearward of the truck cab. Hydraulic cylinders and valve apparatus provide force and control means to swing the fork frame from a lowered loading position to a raised dumping position. Front forks are pivotally mounted at the front of the fork frame. Hydraulic cylinders and valve apparatus provide force and control means, independent of the fork frame controls so that the forks may be rotated and controlled independently of the fork frame.

The conventional full size trash trucks include a top opening access door, hydraulically operated and controlled, that pivotally opens to permit trash to be dumped into the trash truck through a top access panel. Also included in full size trash trucks is a rear door, pivotally attached at its top to the truck body, and hydraulically operated and controlled, so that when operated, the rear door swings up to permit the trash in the truck to be pushed out of the truck.

An ejector blade is mounted inside the body of a full size trash truck. The ejector blade is longitudinally moveable within the truck body for the purpose of compacting the trash and positively forcing the trash out the rear door. The ejector blade is normally operated by a hydraulic cylinder or a feed screw.

With the foregoing in mind, it is an object of this invention to provide a miniature model trash truck that simulates a full size truck of this type.

Yet another object of this invention is to provide this miniature model trash truck with a front fork lift, a top door, a rear door, and an ejector blade all of which move and simulate the actual operation of a full size trash trucks.

Another object is to make the moveable parts of this miniature model trash truck operable by radio control means.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENT

Figure 1:
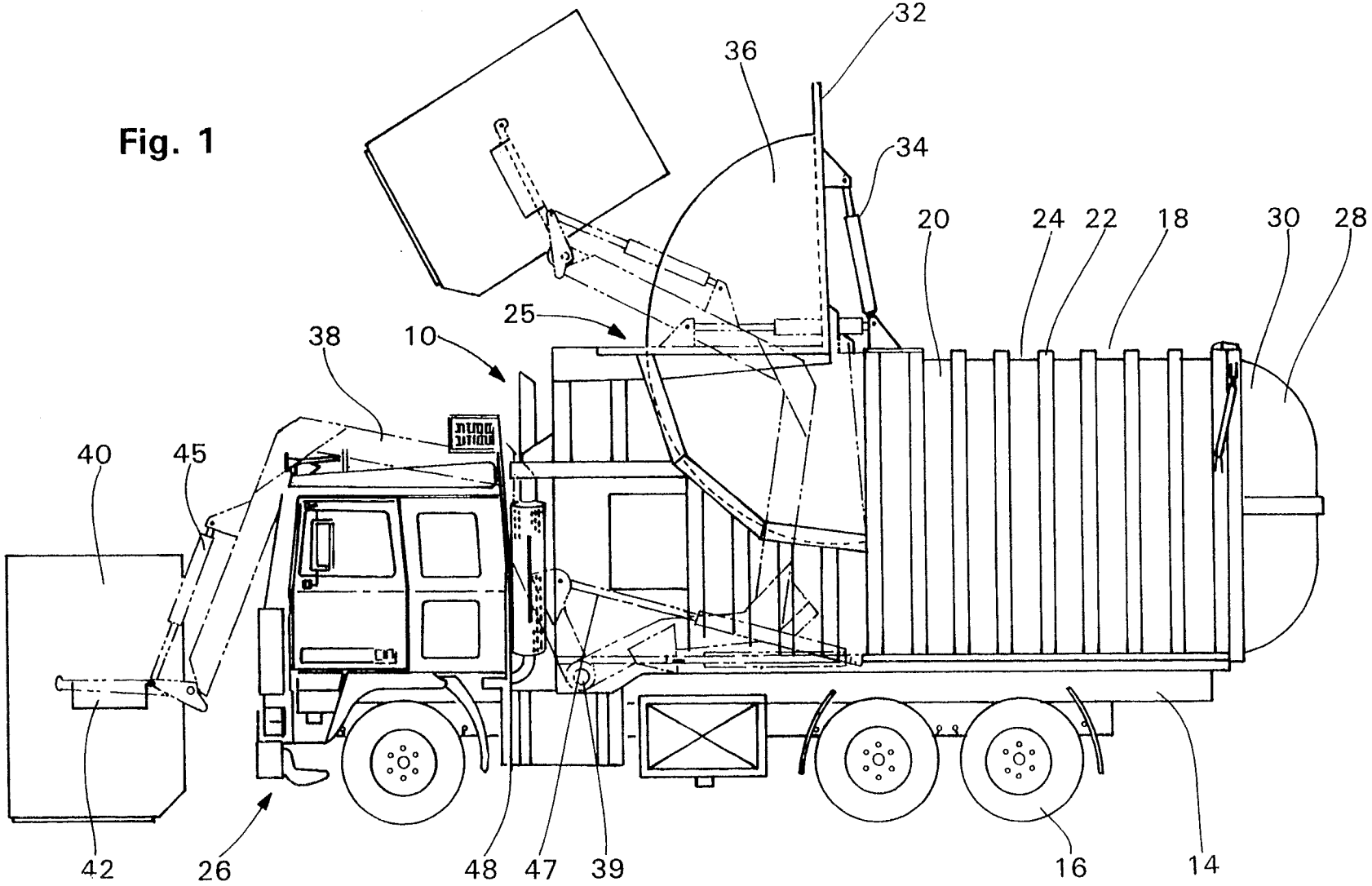
FIG. 1 is a side view of the miniature model trash truck.

Referring to the drawings, there is a miniature model trash truck 10 having chassis 14, wheels 16, body 18, and cab 26. The body 10 is the area of a full size truck in which trash is dumped and stored. Body 18 has sidewalls 20 disposed perpendicular and permanently fastened to top 24, bottom 108, and front wall 106. Ribs 22 fastened to sidewalls 20, top 24 and front wall 106 serve to stiffen these members. Generally, the body 18 is rectangularly shaped having sidewalls 20 spaced apart and parallel. Similarly, top 24 and bottom 108 are spaced apart and parallel. Front wall 106 is opposite rear opening 12. Rear opening 12 simulates the discharge opening in a conventional trash truck. In FIG. 1, fork frame 38, dumpster 40, and top access door are shown in two positions; one position is when forks 56 are down and the truck is preparing to raise a dumpster 40; the other position is when fork frame 38 is up and dumpster 40 is in position to be dumped. In this miniature model, components may be made of wood, plastic, metal or any other material that is easy to work. Similarly, these conventional model building materials may be fabricated by techniques used by model builders when using these materials. Construction and finishing is done in a manner to closely simulate the appearance of a real full size trash truck.

Chassis 14 is a conventional commercially available radio controlled model truck chassis. This type of chassis is controllable and moveable in a forward and rearward direction. The chassis also has a remote controllable steering mechanism. The chassis is completely remotely controllable allowing an operator to steer, move, and control the model truck from an remote location.

Figure 2:
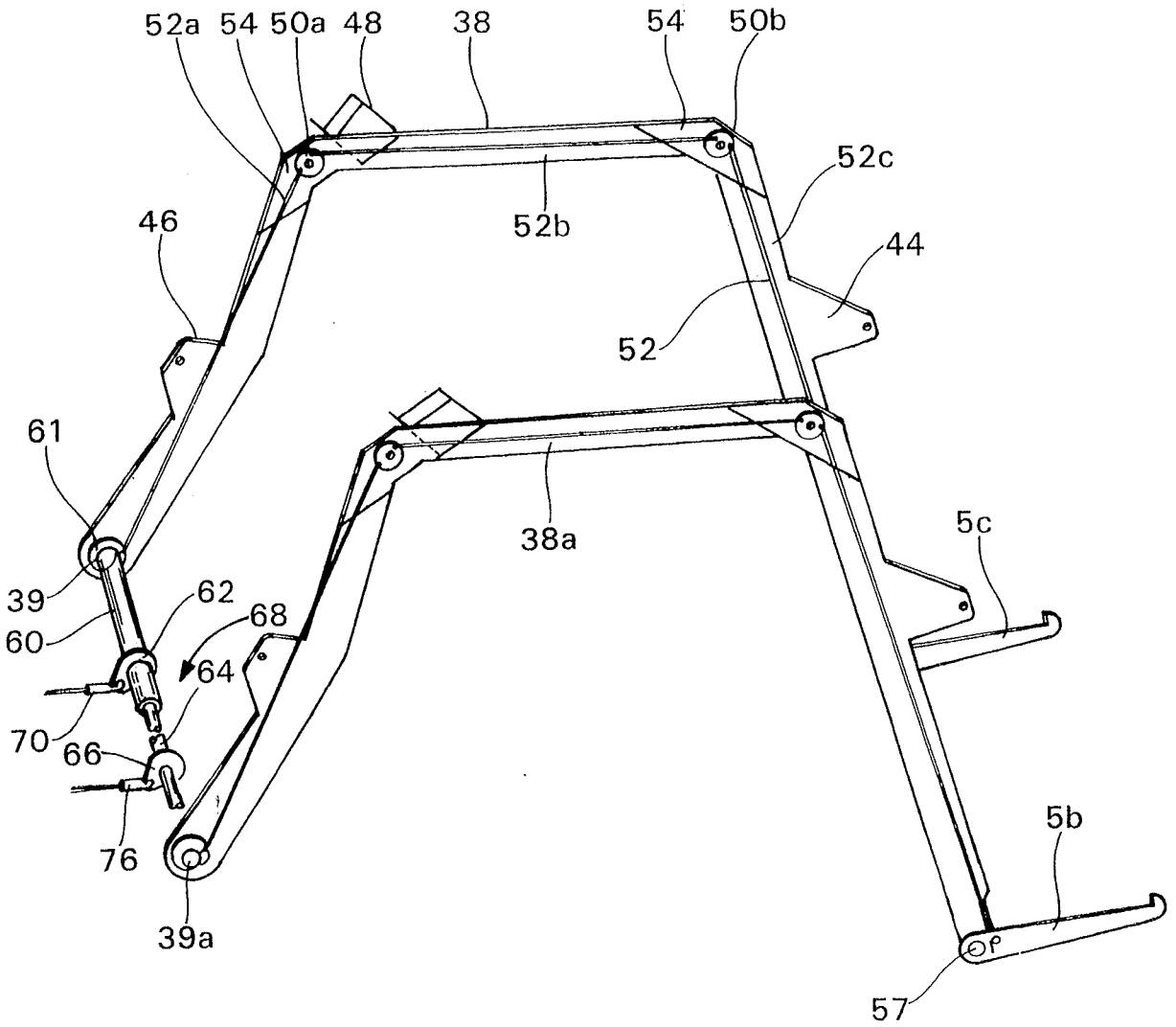
FIG. 2 is an exploded perspective side view of the fork frame.
Figure 3:
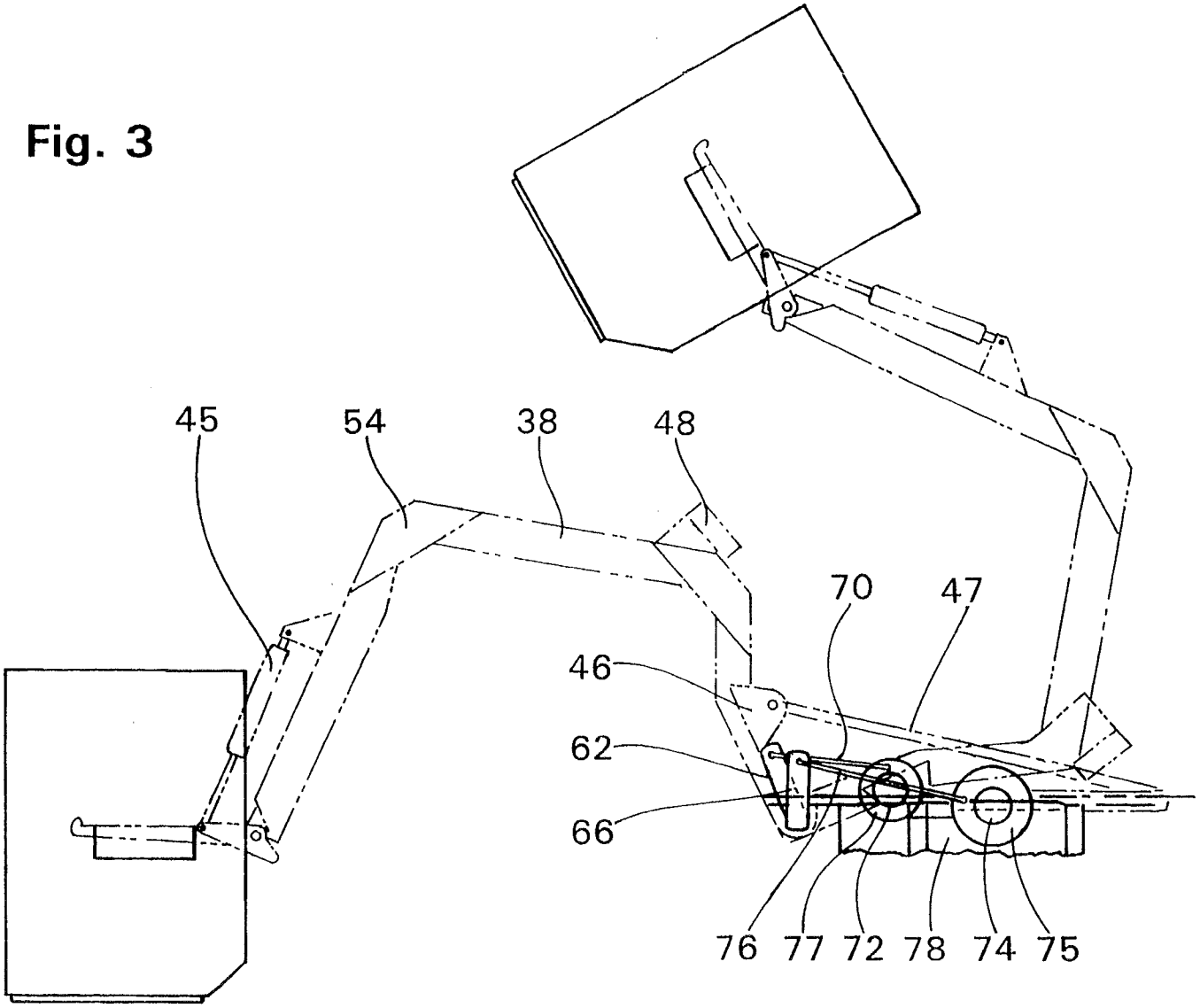
FIG. 3 is a partial longitudinal cross section of the truck showing the fork frame actuating mechanisms.
Figure 4:
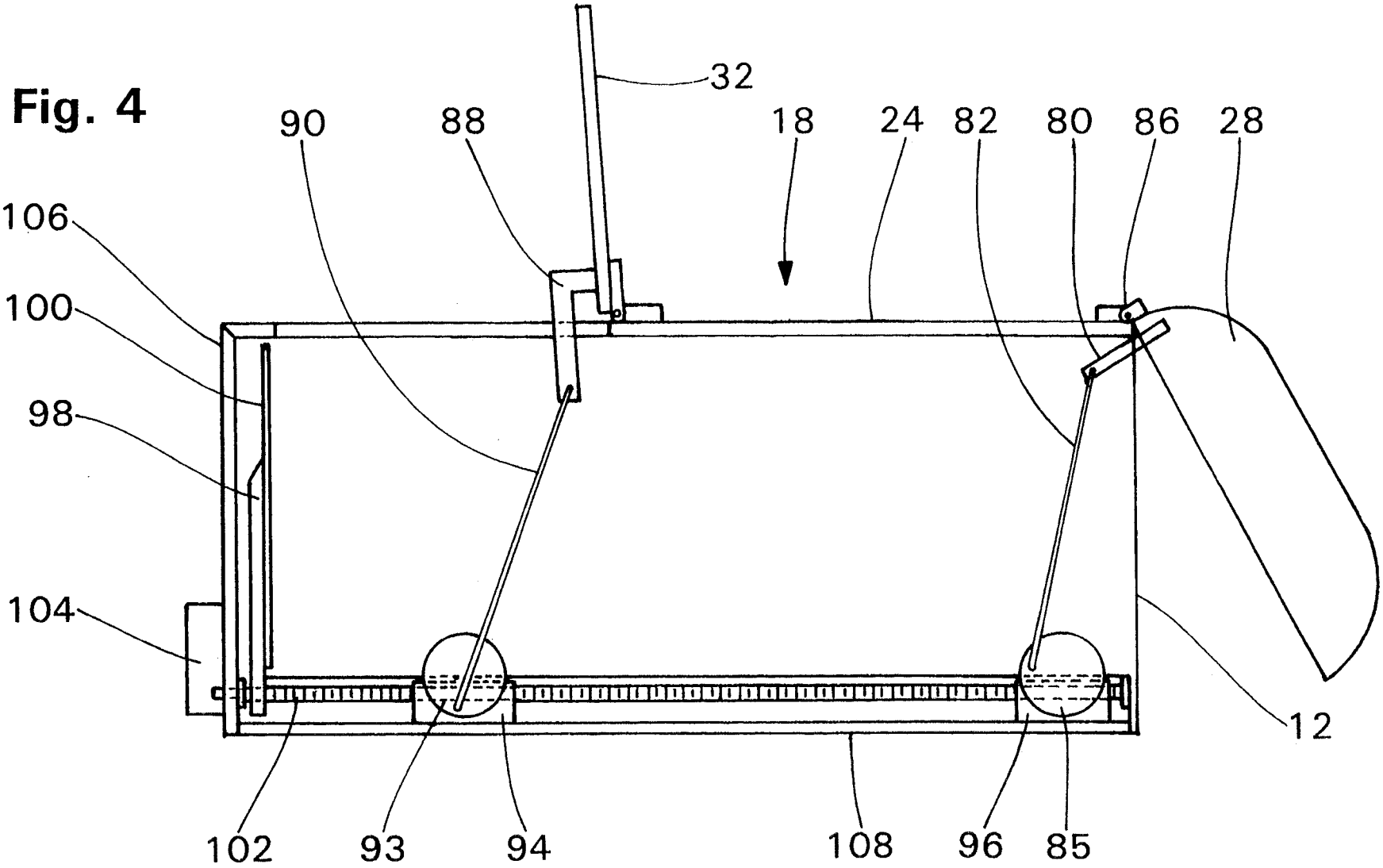
FIG. 4 is a partial longitudinal cross section of the miniature model trash truck showing the actuating mechanisms for the top access door, rear door, and ejector blade.
Figure 5:
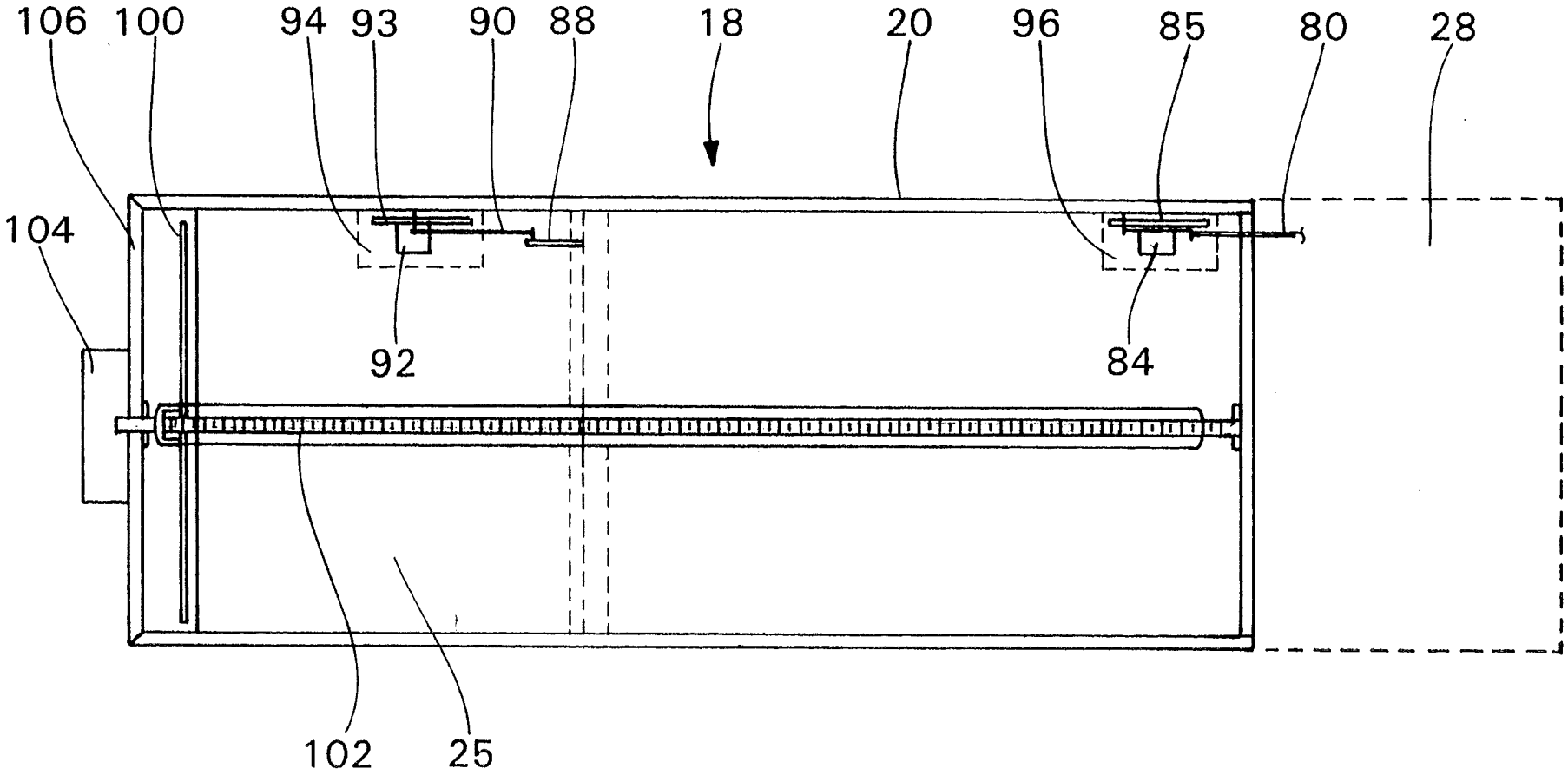
FIG. 5 is a partial top plan view showing the top and rear door actuating mechanisms and the ejector blade actuating mechanism.

As better seen in FIGS. 1 and 2, fork frame 38 is rigidly constructed to simulate the appearance of the fork frame of a real truck. Fork frame 38 comprises fork cylinder bracket 44, gussets 54, fork frame control bracket 46, limit bracket 48, all of which are fabricated to simulate a real fork frame. Fork frame 38 is pivotally mounted at pivot point 39 on truck chassis 14 at a location behind cab 26. A parallel identical fork frame **38*a* is pivotally mounted on the other side of truck chassis 14 at pivot point 39*a*. The two fork frames 38, 38*a* as shown in FIG. 2 are fixedly attached to each other by connecting members (not shown). The connecting members rigidize the fork frame assembly and simulates the actual rigidizing members present on a real trash truck. Forks 56 are pivotally attached to each of the fork frames 38, 38*a***.

Actuation and movement of forks 56 and fork frames 38 is by linkages attached to motor assemblies 72,74. The preferred motor assemblies radio controlled servo motors. The servo shafts (not shown) serve as a fulcrum for eccentrics 71, 75 so that fork cam rod 70 and frame cam rod 76 may be pivotally attached at a distance from the motor shaft. Motors 72,74 are mounted within the body 18 on mounting block 78 so as to be shielded from view and more closely replicate the actual full size trash truck. Fork frame cylinder 47 and fork cylinder 45 are replicas of the hydraulic cylinders on an actual size truck but are non functioning on this miniature model trash truck.

Frame cam rod 76 is pivotally attached to frame offset cam 66 which is affixed to frame torque tube 64. Frame torque tube 64 extends across the inside of body 18, through sidewalls 20 to pivot points 39, 39*a* where it is fixedly attached to fork frames 38, 38*a*. Rotation of the shaft of motor 74, rotates frame eccentric 75 which displaces frame cam rod 76 which rotates frame offset cam 66 and frame torque tube 64 thus rotating fork frames 38, 38*a* around pivot points 39, 39*a*. The result of these motions is the raising and lowering of the fork frames.

Fork torque tube 60 is tubular shaped, fitting over frame torque tube 64 and rotationally free to rotate independently of torque tube 64. Fixed to fork torque tube 60 is fork torque cam 61. A rigid fork cam rod 70 pivotally attaches to cam 61 at a distance from tube 60 axis.

Rotation of the shaft of motor 72, rotates fork eccentric 71 which-displaces fork cam rod 70 which rotates fork offset cam 62 and fork torque tube 60 thus rotating fork torque cam 61. This rotation causes an eccentric reciprocating action in first control rod 52*a* which is pivotally connected to the periphery of a first rotary motion disc 50*a* at a distance from the axis of disc 50*a*. Rotary motion disc 50*a* is rotationally mounted at a corner of fork frame 38. Also pivotally connected at the periphery of first rotary motion disc 50*a* is control rod 52*b*. Rotation of disc 50*a* causes rod 52*b* to reciprocate. Rod 52*b* is pivotally attached to the periphery of a second rotary motion disc 50*b* at a distance from the axis of disc 50*b*. Rotary disc 50*b* is mounted at another corner of frame 38 similarly to disc 50*a*. Pivotally attached to the periphery of disc 50*b* is rod 52*c* which is pivotally attached to fork 56. Motor 72 is radio controlled. Controlled rotation of motor 72 results in fork 56 being rotated around fork pivots 57 by the above described articulated mechanism.

Top access door 32 is pivotally mounted on top 24. Fixedly attached to door 32 are side panels 36 disposed outside of sidewalls 20. When door 32 is raised, side panels 36 form a trough to direct falling matter through top opening 25. In this model, top access door cylinder 34 merely replicates a real cylinder and is non functional. Door 32 is actuated by remote controlled shaft rotation of top door motor 92. Door 32 is fixedly attached to top door bracket 88 which in turn is pivotally attached to rigid top door rod 90. Rod 90 is pivotally attached at its second end to door eccentric 93 which is fixedly attached to the shaft of remotely controlled door motor 92 carried by the top door mounting block 94. Rotation of door motor 92 and door eccentric 93 raises and lowers top access door 32.

Rear access door 28 is pivotally mounted to top 24 at the rear of the body 18. Rear door cylinder 30 replicates a full size hydraulic cylinder but is non functional. Door 28 is actuated by remote controlled shaft rotation of rear door motor 84. Door 28 is fixedly attached to rear door bracket 80 which in turn is pivotally attached to rigid rear door rod 82. Rod 82 is pivotally attached at its second end to door eccentric 85 which is fixedly attached to the shaft of remotely controlled rear door servo 84 carried by the rear door mounting block 96. Rotation of door motor 84 and door eccentric 85 raises and lowers rear door 28.

In a real full size trash truck a longitudinally moveable ejector mechanisms forces trash out the rear door. In this miniature model, remote controlled ejector motor 104 is mounted forwardly of front wall 106. The shaft of ejector motor 104 extends through front wall 106 and is connected to ejector lead screw 102. Ejector support 98 is threadably engaged to lead screw 102 extending vertically therefrom. Fixedly attached to ejector support 98 is ejector blade 100 which extends across the full width of box 18. When remote controlled ejector motor 104 is rotated, the interaction of lead screw 102 and ejector support 98 translate rotational movement into longitudinal movement. Ejector blade 100 is thus moved back and forth between rear opening 12 and front wall 106.

Remote controlled model apparatus necessarily must be free to move about and must run on a portable power source such as batteries. The motors envisioned in this preferred embodiment are direct current servo motors. It should be appreciated, however, that other types of motors may drive the aforementioned mechanisms, and that the claims envision utilization of other motor types. A conventional multi-function remote radio controller such as Model D-14 sold by the Johaness Graupner Company of Kirckham-Tech, Germany, may be provided to control operation of the various servo motors.

Although the invention has been described in considerable detail with reference to the preferred embodiment and other illustrative embodiments, the claims are not limited to these embodiments, but rather are directed to all modifications and variations that are within the spirit and scope of this invention and that may be conceived and reduced to practice by those skilled in the art.

What is claimed is:

1. A miniature model radio controlled trash truck having a body, having a top, a top opening, sidewalls, a front wall, and a rear opening defining a storage space, a chassis, front wheels, and rear wheels which comprises:

(a) a moveable controlled movement fork frame, said fork frame being independently and remotely controlled and pivotally attached to said chassis;

(b) at least one controlled movement fork, said fork being remotely controlled and pivotally attached to the fork frame;

(d) a top access door pivotally attached to the top, said top access door being remotely controlled and covering the top opening when in the down position;

(e) a rear door pivotally attached to the top, said rear door being remotely controlled and covering the rear opening when in the down position; and (f) remote controlled drive means to control movement of the fork frame, fork, access door and rear door.

2. The miniature model radio controlled trash truck of claim 1 wherein said fork, fork frame, top access door and rear door are actuated by remotely controlled electric motors.

3. The miniature model radio controlled trash truck of claim 1 wherein said fork, fork frame, top access door and rear door are actuated by remotely controlled servo motors.

4. The miniature model radio controlled trash truck of claim 1 wherein said truck is propellable in a forward direction by remotely controlled electric motors.

5. The miniature model radio controlled trash truck of claim 3 wherein said truck is propellable in a forwardly and rearwardly direction by remotely controlled electric motors.

6. The miniature model radio controlled trash truck of claim 5 wherein said front wheels are steerable by remotely controlled electric motors means.

7. The miniature model radio controlled trash truck of claim 6 having an ejector blade, said ejector blade being fully enclosed within said body, extending between the sidewalls parallel to the front wall, said ejector blade being slideably moveable between a front loading position and a rear ejecting position.

8. The miniature model radio controlled trash truck of claim 7 further comprising a radio controlled rotating lead screw threadably engaged to said ejector blade.

* * * * *